US009229467B2

(12) United States Patent
Li

(10) Patent No.: US 9,229,467 B2
(45) Date of Patent: Jan. 5, 2016

(54) BANDGAP REFERENCE CIRCUIT AND RELATED METHOD

(71) Applicant: Taiwan Semiconductor Manufacturing Company, Ltd., Hsin-Chu (TW)

(72) Inventor: Chih-Feng Li, Zhubei (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 104 days.

(21) Appl. No.: 13/973,412

(22) Filed: Aug. 22, 2013

(65) Prior Publication Data

US 2015/0054486 A1 Feb. 26, 2015

(51) Int. Cl.
*G05F 3/16* (2006.01)

(52) U.S. Cl.
CPC ..... *G05F 3/16* (2013.01)

(58) Field of Classification Search
USPC ..... 323/901, 311–317; 327/538–543
See application file for complete search history.

(56) References Cited

U.S. PATENT DOCUMENTS

| | | | | |
|---|---|---|---|---|
| 7,746,164 | B2 * | 6/2010 | Ogiwara et al. | 327/541 |
| 2007/0252573 | A1 * | 11/2007 | Tachibana et al. | 323/313 |
| 2014/0015509 | A1 * | 1/2014 | Gupta et al. | 323/313 |
| 2014/0266109 | A1 * | 9/2014 | Zhang et al. | 323/282 |

* cited by examiner

*Primary Examiner* — Nguyen Tran
(74) *Attorney, Agent, or Firm* — Slater & Matsil, L.L.P.

(57) ABSTRACT

A device includes a bandgap reference circuit and a start-up circuit. The bandgap reference circuit includes an amplifier and a first transistor. The amplifier has an inverting input terminal, a non-inverting input terminal, and an output terminal. The first transistor has a gate electrode electrically connected to the output terminal. The start-up circuit has a first path electrically connected to the output terminal and the non-inverting input terminal, and a second path electrically connected to the output terminal and the inverting input terminal.

19 Claims, 3 Drawing Sheets

BANDGAP REFERENCE CIRCUIT AND RELATED METHOD

BACKGROUND

The semiconductor industry has experienced rapid growth due to improvements in the integration density of a variety of electronic components (e.g., transistors, diodes, resistors, capacitors, etc.). For the most part, this improvement in integration density has come from shrinking the semiconductor process node (e.g., shrinking the process node towards the sub-20 nm node).

Shrinking the semiconductor process node entails reductions in operating voltage and current consumption of electronic circuits developed in the semiconductor process node. For example, operating voltages have dropped from 5V to 3.3V, 2.5V, 1.8V, and even 0.9V. A wave of mobile device popularity has increased pressure in the industry to develop low power circuits that only drain minimal operating current from batteries that power the mobile devices. Lower operating current extends battery life of battery-operated mobile devices, such as smartphones, tablet computers, ultrabooks, and the like.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Embodiments will be described with respect to a specific context, namely bandgap reference circuits and related methods. Other embodiments may also be applied, however, to other types of reference circuits.

Throughout the various figures and discussion, like reference numbers refer to like objects or components. Also, although singular components may be depicted throughout some of the figures, this is for simplicity of illustration and ease of discussion. A person having ordinary skill in the art will readily appreciate that such discussion and depiction can be and usually is applicable for many components within a structure.

In the following disclosure, a novel bandgap reference circuit and method are introduced. The bandgap reference circuit uses an asymmetrical start-up circuit to settle output voltage of the bandgap reference circuit rapidly.

Figure 1:
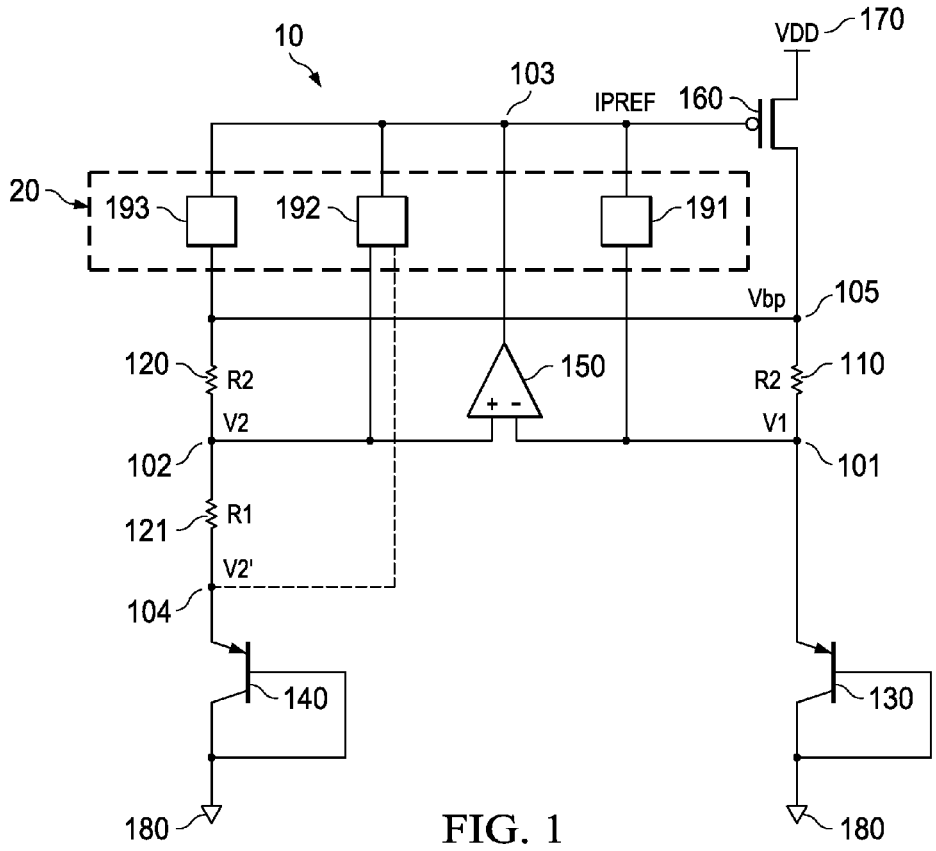
FIG. 1 is a diagram showing a bandgap reference circuit in accordance with various embodiments of the present disclosure.

FIG. 1 is a diagram showing a bandgap reference circuit 10 in accordance with various embodiments of the present disclosure. The bandgap reference circuit 10 includes a start-up circuit 20 (depicted in detail in FIG. 2) that speeds up settling time of a bandgap voltage Vbp, even under low operating current conditions. A first bipolar transistor 130 has an emitter electrode electrically connected to a first node 101, and a collector electrode electrically connected to a second power supply node 180 (e.g., VSS, ground, or the like). A base electrode of the first bipolar transistor 130 is electrically connected to the collector electrode. In some embodiments, the first bipolar transistor 130 is a PNP transistor.

An inverting input terminal of an amplifier 150 is electrically connected to the first node 101. A non-inverting input terminal of the amplifier 150 is electrically connected to a second node 102. An output terminal of the amplifier 150 is electrically connected to a third node 103. Voltage at the third node 103 is substantially equal to gain of the amplifier 150 multiplied by difference of voltage at the second node 102 and voltage at the first node 101. In some embodiments, the amplifier is an operational amplifier. In some embodiments, the amplifier 150 is replaced by another circuit capable of causing the voltage at the second node 102 to be substantially equal to the voltage at the first node 101.

A first resistor 121, having resistance R1, has a first terminal electrically connected to the second node 102, and a second terminal electrically connected to a fourth node 104. An emitter electrode of a second bipolar transistor 140 is electrically connected to the fourth node 104. A collector electrode of the second bipolar transistor 140 is electrically connected to the second power supply node 180. A base electrode of the second bipolar transistor 140 is electrically connected to the second power supply node 180. In some embodiments, the second bipolar transistor 140 is a PNP transistor.

The bandgap voltage Vbp is outputted at a fifth node 105. A first terminal of a second resistor 110, having resistance R2, is electrically connected to the fifth node 105. A second terminal of the second resistor 110 is electrically connected to the first node 101. A first terminal of a third resistor 120, having resistance R2, is electrically connected to the fifth node 105. A second terminal of the third resistor 120 is electrically connected to the second node 102.

An output signal IPREF is generated by the amplifier 150 at the third node 103. A gate electrode of a transistor 160 is electrically connected to the third node 103. A source electrode of the transistor 160 is electrically connected to a first power supply node 170 (e.g., VDD). A drain electrode of the transistor 160 is electrically connected to the fifth node 105. In some embodiments, the transistor 160 is a P-type metal-oxide-semiconductor (PMOS) transistor. In some embodiments, voltage VDD is in a range of about 1.2 Volts to about 5 Volts.

In some embodiments, the start-up circuit 20 is electrically connected to the third node 103, the fifth node 105, the first node 101, and the second node 102. In some embodiments, the start-up circuit 190 is electrically connected to the third node 103, the fifth node 105, the first node 101, and the fourth node 104 (shown by a dotted line). A first start-up unit 191 is electrically connected to the third node 103 and the first node 101. A second start-up unit 192 is electrically connected to the third node 103 and the second node 102 (or the fourth node 104). A third start-up unit 193 is electrically connected to the third node 103 and the fifth node 105. A control circuit 240

(see FIG. 2) is electrically connected to the third node 103, and to the first, second, and third start-up units 191-193.

Figure 2:
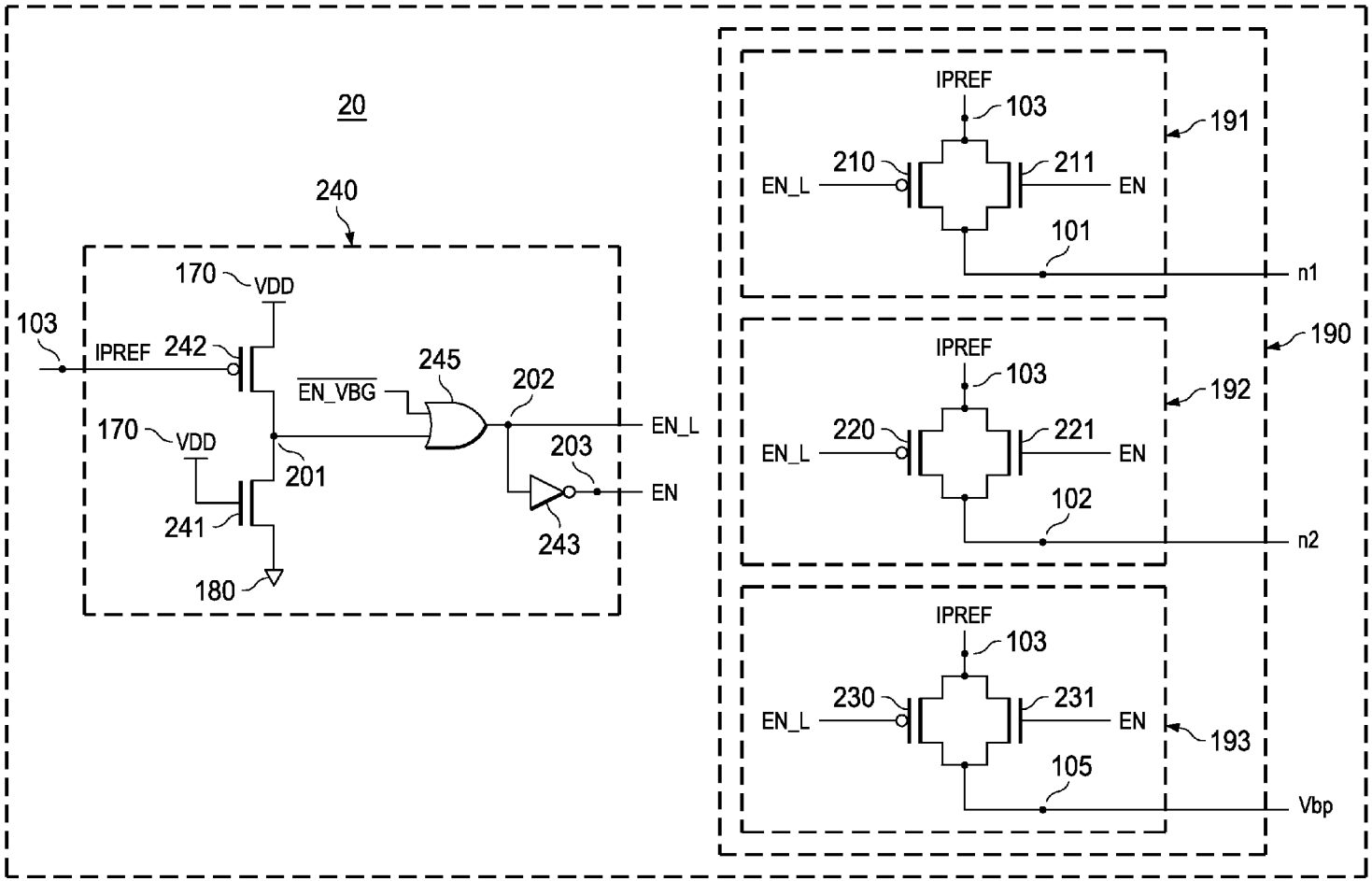
FIG. 2 is a diagram showing a start-up circuit in accordance with various embodiments of the present disclosure.

FIG. 2 is a diagram showing the start-up circuit 20 in accordance with various embodiments of the present disclosure. The first, second, and third start-up units 191, 192, 193 are part of a start-up module 190 of the start-up circuit 20. An enable circuit 240 of the start-up circuit 20 is controlled by a bandgap enable bar signal $\overline{\text{EN_VBG}}$ to enable the first, second, and third start-up units 191-193. The enable circuit 240 outputs an enable signal EN at a node 203, and an enable bar signal EN_L at a node 202.

In some embodiments, the first start-up unit 191 includes a transmission gate including a first transistor 210 and a second transistor 211. The first transistor 210 has a drain electrode electrically connected to the first node 101, a source electrode electrically connected to the third node 103, and a gate electrode electrically connected to the node 202. The second transistor 211 has a drain electrode electrically connected to the third node 103, a source electrode electrically connected to the first node 101, and a gate electrode electrically connected to the node 203. In some embodiments, the first transistor 210 is a PMOS transistor, and the second transistor 211 is an NMOS transistor.

In some embodiments, the second start-up unit 192 includes a transmission gate including a first transistor 220 and a second transistor 221. The first transistor 220 has a drain electrode electrically connected to the second node 102, a source electrode electrically connected to the third node 103, and a gate electrode electrically connected to the node 202. The second transistor 221 has a drain electrode electrically connected to the third node 103, a source electrode electrically connected to the second node 102, and a gate electrode electrically connected to the node 203. In some embodiments, the first transistor 220 is a PMOS transistor, and the second transistor 221 is an NMOS transistor.

In some embodiments, the third start-up unit 193 includes a transmission gate including a first transistor 230 and a second transistor 231. The first transistor 230 has a drain electrode electrically connected to the fifth node 105, a source electrode electrically connected to the third node 103, and a gate electrode electrically connected to the node 202. The second transistor 231 has a drain electrode electrically connected to the third node 103, a source electrode electrically connected to the fifth node 105, and a gate electrode electrically connected to the node 203. In some embodiments, the first transistor 230 is a PMOS transistor, and the second transistor 231 is an NMOS transistor.

In some embodiments, sizes (e.g., width/length ratios) of the first and second transistors 210, 211 of the first start-up unit 191 are larger than sizes of the first and second transistors 220, 221 of the second start-up unit 192. In some embodiments, the sizes of the first and second transistors 210, 211 are more than about 5 times larger and less than about 25 times larger than the sizes of the first and second transistors 220, 221. In some embodiments, the sizes of the first and second transistors 210, 211 are more than about 8 times larger and less than about 21 times larger than the sizes of the first and second transistors 220, 221.

The enable circuit 240 of the start-up circuit 20 is controlled by the bandgap enable bar signal $\overline{\text{EN_VBG}}$ to enable the first, second, and third start-up units 191-193. The enable circuit 240 outputs the enable signal EN at the node 203 and the enable bar signal EN_L having inverted logic level of the enable signal EN at the node 202. An inverter 243 of the enable circuit 240 inverts the enable bar signal EN_L at the node 202 to generate the enable signal EN at the node 203. A logic gate 245 generates the enable bar signal EN_L at the node 202 based on the bandgap enable bar signal $\overline{\text{EN_VBG}}$ and logic level of a node 201. In some embodiments, the logic gate 245 is an OR gate.

A first transistor 241 of the enable circuit 240 has a drain electrode electrically connected to the node 201, a source electrode electrically connected to the second power supply node 180 (e.g., ground), and a gate electrode electrically connected to the first power supply node 170. In some embodiments, the first transistor 241 is an N-type metal-oxide-semiconductor (NMOS) transistor. A second transistor 242 of the enable circuit 240 has a drain electrode electrically connected to the node 201, a source electrode electrically connected to the first power supply node 170, and a gate electrode electrically connected to the third node 103 corresponding to the output terminal of the amplifier 150. In some embodiments, the second transistor 242 is a P-type metal-oxide-semiconductor (PMOS) transistor.

In a standby state, the output signal IPREF has first voltage (e.g., VDD) similar to the voltage of the first power supply node 170. The first voltage at the gate electrode of the transistor 160 sets up a source-gate voltage (VSG) of substantially zero Volts biasing the transistor 160. As a result, the transistor 160 is turned off in the standby state. Among other advantages, the transistor 160 being turned off prevents standby current to save power.

The first voltage is also present at the gate electrodes of the first and second transistors 241, 242 of the enable circuit 240. Similar to the transistor 160, the second transistor 242 is turned off by a source-gate voltage (VSG) of substantially zero Volts biasing the second transistor 242. The first voltage sets up a gate-source voltage (VGS) of the first transistor 241 that exceeds a threshold voltage (Vthn) of the first transistor 241. As a result, the first transistor 241 is turned on in the standby state. A second voltage (e.g., ground) at the second power supply node 180 pulls down voltage at a first input terminal of the logic gate 245 at the node 201 through the first transistor 241.

A second input terminal of the logic gate 245 receives the bandgap enable bar signal $\overline{\text{EN_VBG}}$. In the standby state, the bandgap enable bar signal $\overline{\text{EN_VBG}}$ is at a logic high voltage (e.g., the first voltage). As a result, output voltage at an output terminal of the logic gate 245 electrically connected to the node 202 is at the logic high voltage. The enable bar signal EN_L is at the logic high voltage, and the enable signal EN is at the logic low voltage in the standby state. As a result, the first, second, and third start-up units are disabled in the standby state. By way of illustration, the first transistor 210 is turned off by the logic high voltage at its gate electrode, and the second transistor 211 is turned off by the logic low voltage at its gate electrode.

In a start-up operation, coming out of the standby state, the enable signal EN is transitioned to the logic high voltage, and the enable bar signal EN_L is transitioned to the logic low voltage as a result of the bandgap enable bar signal $\overline{\text{EN_VBG}}$ being transitioned to the logic low voltage. The logic low voltage of the enable bar signal EN_L at the node 202 turns on the first transistors 210, 220, 230 of the first, second, and third start-up units 191, 192, 193. The logic high voltage of the enable signal EN at the node 203 turns on the second transistors 211, 221, 231 of the first, second and third start-up units 191, 192, 193. Electrical charge built up at the third node 103 in the standby state is transferred to the first, second (or fourth), and fifth nodes 101, 102 (or 104), 105 through charge sharing by the first, second, and third start-up units 191, 192, 193. The charge sharing to the first and second (or fourth)

nodes 101, 102 (or 104) is asymmetrical due to the first and second transistors 210, 211 being larger than the first and second transistors 220, 221.

Due to the asymmetrical nature of the charge sharing to the first node 101 and the second node 102 (or the fourth node 104), voltage V1 at the inverting input terminal of the amplifier 150 rises more rapidly than voltage V2 (or voltage V2') at the non-inverting input terminal of the amplifier 150. Following the beginning of the start-up period, the voltage V1 is greater than the voltage V2, which sets up a voltage difference across the inverting input terminal and the non-inverting input terminal of the amplifier 150. The voltage difference is amplified by the amplifier 150 to pull down the voltage IPREF at the gate electrode of the transistor 160. Source-gate voltage (VSG) of the transistor 160 is increased, so that current flowing into the fifth node 105 from the drain electrode of the transistor 160 is also increased. A large current $I_{LARGE}$ flows through the first resistor 121, and the output voltage Vbp of the bandgap reference circuit 10 is charged. As the output voltage Vbp approaches a target voltage, the voltage V2 ($V2=V2'+I_{LARGE}*R1$) is brought to approximately equal the voltage V1, which is about a base-emitter voltage (Vbe) of the first bipolar transistor 130.

Figure 3:
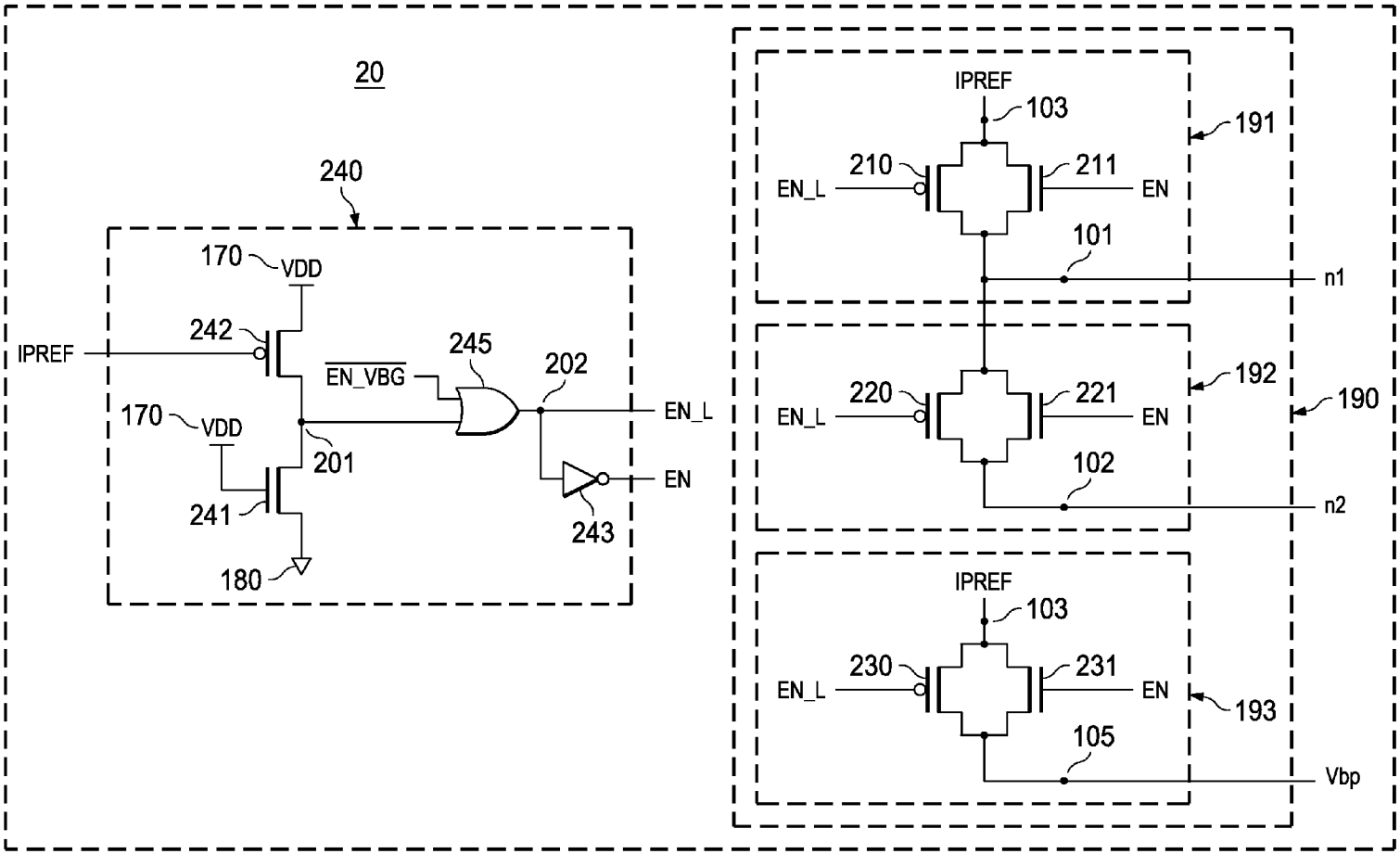
FIG. 3 is a diagram showing a start-up circuit in accordance with various embodiments of the present disclosure.

FIG. 3 is a diagram showing the start-up circuit 20 in accordance with various embodiments of the present disclosure. In the configuration shown in FIG. 3, the first start-up unit 191 is daisy-chained with the second start-up unit 192. In some embodiments, the source electrode of the first transistor 220 and the drain electrode of the second transistor 221 are electrically connected to the drain electrode of the first transistor 210 and the source electrode of the second transistor 211 (the node 101). In some embodiments, the sizes (e.g., width/length ratios) of the first and second transistors 210, 211 of the first start-up unit 191 are larger than sizes of the first and second transistors 220, 221 of the second start-up unit 192. In some embodiments, the sizes of the first and second transistors 210, 211 are substantially the same as the sizes of the first and second transistors 220, 221.

The start-up circuit 20 of FIG. 3 achieves asymmetrical charge sharing from the third node 103 to the first and second nodes 101, 102 by delaying the charge sharing to the second node 102 relative to the charge sharing to the first node 101. A second path from the third node 103 to the second node 102 is longer than a first path from the third node 103 to the first node 101. The first path includes the first and second transistors 210, 211. The second path includes the first and second transistors 210, 211 and the first and second transistors 220, 221. As a result, the first node 101 charges more rapidly than the second node 102, and the voltage V1 is initially higher than the voltage V2. Further effects of the asymmetrical charge sharing are described above with reference to FIG. 2, and not repeated here for brevity.

Figure 4:
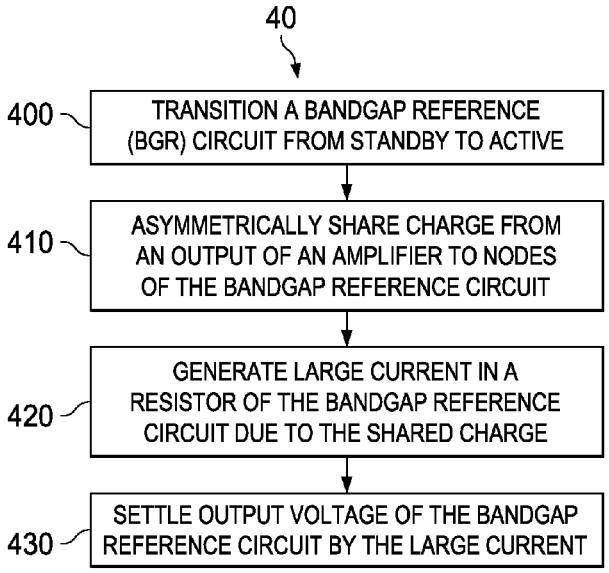
FIG. 4 is a flowchart showing a process for starting up a bandgap reference circuit in accordance with various embodiments of the present disclosure.

FIG. 4 is a flowchart showing a process 40 for starting up a bandgap reference circuit in accordance with various embodiments of the present disclosure. The process 40 is compatible with the bandgap reference circuit 10 using the start-up circuit 20 of FIG. 2 or FIG. 3. For purposes of illustration, the process 40 is described in terms of FIGS. 1, 2 and 3, but the process 40 is not limited to the structures shown and described.

The bandgap reference circuit 10 is transitioned 400 from the standby state to an active state. In the standby state, internal nodes of the bandgap reference circuit 10, such as the first, second, fourth, and fifth nodes 101, 102, 104, 105 are at a low voltage (e.g., 0 Volts), and the third node 103 is at about the first voltage (e.g., VDD). In some embodiments, the transitioning 400 is initiated directly or indirectly by transitioning a control signal. In some embodiments, the control signal is the bandgap enable bar signal $\overline{EN_VBG}$. In some embodiments, the transitioning of the control signal is transitioning the bandgap enable bar signal $\overline{EN_VBG}$ from a logic high voltage (e.g., VDD) to a logic low voltage (e.g., 0 Volts). In some embodiments, the transitioning 400 is performed in the start-up circuit 20.

Charge stored at the third node 103 in the standby state is shared 410 asymmetrically from the output terminal of the amplifier 150 to at least two of the internal nodes of the bandgap reference circuit 10. In some embodiments, the charge is shared 410 asymmetrically to the first node 101 and the second node 102. In some embodiments, the charge is shared 410 disproportionately more to the first node 101 than to the second node 102. In some embodiments, the charge is shared 410 to the first node 101 faster than to the second node 102. In some embodiments, the sharing 410 is asymmetric by sharing 410 the charge through a first pass gate (e.g., the first and second transistors 210, 211) that has a first size larger than a second size of a second pass gate (e.g., the first and second transistors 220, 221). In some embodiments, the sharing 410 is asymmetric by sharing 410 the charge through a first pass gate (e.g., the first and second transistors 210, 211) that is electrically closer to the third node 103 than a second pass gate (e.g., the first and second transistors 220, 221). For example, the second pass gate in FIG. 3 is electrically connected to the third node 103 through the first pass gate. In some embodiments, the charge is shared 410 asymmetrically by electrically connecting the first node 101 to the third node 103 by a first path, and electrically connecting the second node 102 to the third node 103 by a second path. The second path is longer (e.g., has greater delay) than the first path. For example, the first path includes the first pass gate, and the second path includes the first pass gate and the second pass gate.

Large current is generated 420 in the first resistor 121 due to the shared charge. In some embodiments, the large current is generated 420 by increasing the source-gate voltage VSG of the transistor 160 electrically connected to the output terminal of the amplifier 150 to increase current output of the transistor 160. The increasing is accomplished by lowering gate voltage at the gate electrode of the transistor 160. The lowering is performed by the amplifier 150, which amplifies the voltage difference between the voltage at the first node 101 and the voltage at the second node 102. The voltage difference causes a decrease in output voltage (the gate voltage) due to the voltage at the first node 101 (corresponding to the inverting input terminal) being higher than the voltage at the second node 102. The voltage at the first node 101 is higher than the voltage at the second node 102 due to the asymmetrical charge sharing 410. The large current acts to settle 430 the output voltage at the fifth node 105.

Embodiments may achieve advantages. The asymmetrical charge sharing 410 accomplished by the first and second transistors 210, 211 and the first and second transistors 220, 221 sets up the voltage difference across the input terminals of the amplifier 150, which induces 420 the large current in the first resistor 121. This allows the bandgap reference circuit 10 to settle rapidly in the start-up mode. The process 40 is also very beneficial to low current bandgap reference circuits, which normally suffer from poor current driving capability (slow responsiveness).

In accordance with various embodiments of the present disclosure, a device includes a bandgap reference circuit and a start-up circuit. The bandgap reference circuit includes an amplifier and a first transistor. The amplifier has an inverting input terminal, a non-inverting input terminal, and an output terminal. The first transistor has a gate electrode electrically connected to the output terminal. The start-up circuit has a first path electrically connected to the output terminal and the non-inverting input terminal, and a second path electrically connected to the output terminal and the inverting input terminal.

In accordance with various embodiments of the present disclosure, a device comprises first and second transistors, an amplifier, a first resistor, a third transistor, second and third resistors, and a start-up circuit. The first transistor has an emitter electrode electrically connected to a first node, and base and collector electrodes electrically connected to a second power supply node. The second transistor has an emitter electrode electrically connected to a fourth node, and base and collector electrodes electrically connected to the second power supply node. The amplifier has a non-inverting input terminal electrically connected to a second node, and an inverting input terminal electrically connected to the first node. The first resistor has a first terminal electrically connected to the second node, and a second terminal electrically connected to the fourth node. The third transistor has a gate electrode electrically connected to an output terminal of the amplifier, a source electrode electrically connected to a first power supply node, and a drain electrode electrically connected to a fifth node. The second resistor has a first terminal electrically connected to the second node, and a second terminal electrically connected to the fifth node. The third resistor has a first terminal electrically connected to the first node, and a second terminal electrically connected to the fifth node. The start-up circuit has a first start-up unit having a first terminal electrically connected to the gate electrode and a second terminal electrically connected to the first node, and a second start-up unit having a first terminal electrically connected to the gate electrode and a second terminal electrically connected to the inverting input terminal.

In accordance with various embodiments of the present disclosure, a method comprises transitioning a bandgap reference circuit from a standby state to an active state; asymmetrically sharing charge from an output of an amplifier of the bandgap reference circuit to inverting and non-inverting input terminals of the amplifier by a start-up circuit; generating current in a resistor of the bandgap reference circuit due to the shared charge; and settling output voltage of the bandgap reference circuit by the current.

As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used in either the detailed description or the claims, such terms are intended to be inclusive in a manner similar to the term "comprising". Moreover, the term "between" as used in this application is generally inclusive (e.g., "between A and B" includes inner edges of A and B).

Although the present embodiments and their advantages have been described in detail, it should be understood that various changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A device comprising:

a bandgap reference circuit comprising:

an amplifier having an inverting input terminal, a non-inverting input terminal, and an output terminal; and a first transistor having a gate electrode electrically connected to the output terminal; and a start-up circuit comprising:

a first path electrically connected to the output terminal and the non-inverting input terminal, wherein the first path comprises a first pass gate, the first pass gate comprising a first N-type transistor of a first size and a first P-type transistor of a second size; and a second path electrically connected to the output terminal and the inverting input terminal, wherein the second path comprises a second pass gate, the second pass gate comprising a second N-type transistor of a third size larger than the first size and a second P-type transistor of a fourth size larger than the second size.

2. The device of claim 1 wherein the third size is greater than about 7 times larger than the first size.

3. The device of claim 2, wherein the third size is less than about 22 times larger than the first size.

4. The device of claim 1, wherein:

the second pass gate has a first terminal electrically connected to the output terminal and a second terminal electrically connected to the inverting input terminal;

the first pass gate has a third terminal electrically connected to the second terminal, and a fourth terminal electrically connected to the non-inverting input terminal; and the first path further comprises the second pass gate.

5. The device of claim 1, wherein the start-up circuit further comprises:

a third path electrically connected to the output terminal and a drain electrode of the first transistor.

6. The device of claim 1, further comprising a first resistor having a first terminal electrically connected to the non-inverting input terminal, wherein the first path is electrically connected to the non-inverting input terminal through the first resistor.

7. A device comprising:

a first transistor having an emitter electrode electrically connected to a first node, and base and collector electrodes electrically connected to a second power supply node;

a second transistor having an emitter electrode electrically connected to a fourth node, and base and collector electrodes electrically connected to the second power supply node;

an amplifier having:

a non-inverting input terminal electrically connected to a second node; and an inverting input terminal electrically connected to the first node;

a first resistor having a first terminal electrically connected to the second node, and a second terminal electrically connected to the fourth node;

a third transistor having:

a gate electrode electrically connected to an output terminal of the amplifier at a third node;

a source electrode electrically connected to a first power supply node; and a drain electrode electrically connected to a fifth node;

a second resistor having a first terminal electrically connected to the second node, and a second terminal electrically connected to the fifth node;

a third resistor having a first terminal electrically connected to the first node, and a second terminal electrically connected to the fifth node; and a start-up circuit having:

a first start-up unit having a first terminal of a first pass gate electrically connected to the gate electrode and a second terminal of the first pass gate electrically connected to the first node; and a second start-up unit having a first terminal of a second pass gate electrically connected to the gate electrode and a second terminal of the second pass gate electrically connected to the non-inverting input terminal.

8. The device of claim 7, wherein the second terminal of the second pass gate unit is directly electrically connected to the second node.

9. The device of claim 7, wherein the second terminal of the second pass gate unit is directly electrically connected to the fourth node.

10. The device of claim 7, wherein the first start-up unit is larger than the second start-up unit.

11. The device of claim 7, wherein the second start-up unit is electrically connected to the gate electrode through the first start-up unit.

12. The device of claim 7, wherein the start-up circuit further comprises an enable circuit comprising:

an OR-type logic gate having a first input terminal, a second input terminal, and an output terminal electrically connected to first enable terminals of the first and second start-up units;

an inverter logic gate having an input terminal electrically connected to the output terminal of the OR-type logic gate, and an output terminal electrically connected to second enable terminals of the first and second start-up units;

a fourth transistor having:

a source electrode electrically connected to the first power supply node;

a drain electrode electrically connected to the second input terminal of the OR-type logic gate; and a gate electrode electrically connected to the third node; and a fifth transistor having:

a source electrode electrically connected to the second power supply node;

a drain electrode electrically connected to the second input terminal of the OR-type logic gate; and a gate electrode electrically connected to the first power supply node.

13. A method comprising:

transitioning a bandgap reference circuit from a standby state to an active state;

asymmetrically sharing charge from an output of an amplifier of the bandgap reference circuit to inverting and non-inverting input terminals of the amplifier by a start-up circuit;

generating current in a resistor of the bandgap reference circuit due to the shared charge; and settling output voltage of the bandgap reference circuit by the current.

14. The method of claim 13, wherein the transitioning comprises:

transitioning a control signal controlling an enable circuit of the start-up circuit.

15. The method of claim 13, wherein the asymmetrically sharing comprises:

sharing more charge to the inverting input terminal than to the non-inverting input terminal.

16. The method of claim 13, wherein the asymmetrically sharing comprises:

sharing charge to the inverting input terminal faster than to the non-inverting input terminal.

17. The method of claim 13, further comprising:

sharing charge from the output of the amplifier to a bandgap voltage output node of the bandgap reference circuit.

18. The method of claim 13, wherein the generating comprises:

amplifying a voltage difference across the inverting and non-inverting input terminals caused by the asymmetrical charge sharing; and increasing source-gate voltage of a transistor sourcing current to the resistor.

19. The method of claim 13, further comprising:

establishing the charge at the output of the amplifier while the bandgap reference circuit is in the standby state.

* * * * *